US007290660B2

(12) United States Patent
Tilman et al.

(10) Patent No.: US 7,290,660 B2
(45) Date of Patent: Nov. 6, 2007

(54) STORAGE SYSTEM HAVING A DISPOSABLE VACUUM BAG

(76) Inventors: Paul A. Tilman, W 4852 Forest La., Sherwood, WI (US) 54169; Michael E. Schreiter, 1912 Schaefer Cir., Appleton, WI (US) 54915; James E. Buchman, W8695 Spring Rd., Hortonville, WI (US) 54944; Robert P. Gerrits, 1120 Tullar Rd., Neenah, WI (US) 54956; Pamala L. Guy, N4769 French Rd., Seymore, WI (US) 54165; James J. Mischler, 2004 W. Glendale Ave., Appleton, WI (US) 54914; Paul J. Tretina, 4816 Kellywood Dr., Glen Allen, VA (US) 23060; Giles Douglas Powell, Jr., 2515 Cedar Cone Dr., Richmond, VA (US) 23230; Bruce Robbins, 1506 Treboy Ave., Richmond, VA (US) 23237; Amy M. Standard, 404 Shadow Creek La., Manakin Sabot, VA (US) 23103; Mladomir Tomic, 4624 W. Grand Meadows Dr., Appleton, WI (US) 54915; Judith A. Yaeger, 619 Tonka St., Appleton, WI (US) 54911; Marc L. Vitantonio, 121 Countryside Dr., South Russell, OH (US) 44022; Craig M. Saunders, 21471 Aberdeen Rd., Rocky River, OH (US) 44116

( * ) Notice: Subject to any disclaimer, the term of this patent is extended or adjusted under 35 U.S.C. 154(b) by 0 days.

(21) Appl. No.: 11/186,131

(22) Filed: Jul. 20, 2005

(65) Prior Publication Data

US 2006/0048483 A1 Mar. 9, 2006

Related U.S. Application Data

(60) Provisional application No. 60/609,920, filed on Sep. 15, 2004, provisional application No. 60/602,685, filed on Aug. 19, 2004, provisional application No. 60/590,858, filed on Jul. 23, 2004.

(51) Int. Cl.
*B65D 81/20* (2006.01)

(52) U.S. Cl. ..... 206/524.8; 383/63; 383/103

(58) Field of Classification Search ..... 206/524.8; 383/63–65, 103; 137/515.15, 550, 843, 852, 137/854, 512.15
See application file for complete search history.

(56) References Cited

U.S. PATENT DOCUMENTS

| | | | | | |
|---|---|---|---|---|---|
| 2,142,970 | A | | 1/1939 | Anderson | 137/146 |
| 2,385,176 | A | | 9/1945 | White | 33/50 |
| 2,576,322 | A | | 11/1951 | Waters | 229/62.5 |
| 2,778,171 | A | | 1/1957 | Taunton | 53/9 |
| 2,778,173 | A | | 1/1957 | Taunton | 53/22 |
| 2,870,954 | A | | 1/1959 | Kulesza | 229/62.5 |
| 2,913,030 | A | | 11/1959 | Fisher | 150/52 |
| 2,946,502 | A | | 7/1960 | Metzger | 229/62.5 |
| 3,054,551 | A | | 9/1962 | Holbrook et al. | 229/86 |
| 3,224,574 | A | | 12/1965 | McConnell et al. | 206/56 |
| 3,591,870 | A | | 7/1971 | Friesen et al. | 4/110 |
| 3,823,750 | A | | 7/1974 | Owen | 141/65 |
| 3,949,934 | A | | 4/1976 | Goglio | 383/103 |
| 3,980,226 | A | | 9/1976 | Franz | 383/71 |
| 4,016,999 | A | | 4/1977 | Denzer | 220/231 |
| 4,051,971 | A | | 10/1977 | Saleri et al. | 215/260 |
| 4,105,491 | A | | 8/1978 | Haase et al. | 156/553 |
| RE30,045 | E | | 7/1979 | Greene | 206/455 |
| 4,267,960 | A | | 5/1981 | Lind et al. | 383/106 |
| 4,295,566 | A | | 10/1981 | Vincek | 206/457 |
| 4,310,118 | A | | 1/1982 | Kisida et al. | 383/102 |
| 4,337,804 | A | | 7/1982 | Maruscak | 141/65 |
| 4,340,558 | A | | 7/1982 | Hendrickson | 264/151 |
| 4,354,541 | A | * | 10/1982 | Tilman | 383/63 |
| 4,571,924 | A | | 2/1986 | Bahrani | 53/453 |
| 4,601,410 | A | | 7/1986 | Bond | 222/92 |
| 4,620,320 | A | | 10/1986 | Sullivan | 383/203 |
| 4,690,667 | A | | 9/1987 | Domke | 493/213 |
| 4,702,376 | A | | 10/1987 | Pagliaro | 206/524.8 |
| 4,715,494 | A | | 12/1987 | Heitzenroder et al. | 206/213.1 |
| 4,731,978 | A | | 3/1988 | Martensson | 53/468 |
| 4,756,140 | A | | 7/1988 | Gannon | 53/434 |

4,761,080 A 8/1988 Schirmer ..... 383/120
4,838,429 A 6/1989 Fabisiewicz et al. ..... 383/205
4,890,935 A 1/1990 Ausnit et al. ..... 383/59
4,892,414 A 1/1990 Ausnit ..... 383/63
4,954,124 A 9/1990 Erickson et al. ..... 493/195
4,986,673 A 1/1991 Bell ..... 383/204
5,053,091 A 10/1991 Giljam et al. ..... 156/66
5,059,036 A 10/1991 Richison et al. ..... 383/61.2
5,215,275 A 6/1993 Gold ..... 493/194
5,228,271 A 7/1993 Wallace ..... 53/434
5,240,112 A 8/1993 Newburger ..... 206/524.8
5,246,114 A 9/1993 Underwood ..... 206/524.8
5,252,281 A 10/1993 Kettner et al. ..... 264/173.17
5,287,680 A 2/1994 Lau ..... 53/512
5,293,672 A 3/1994 Tominaga et al. ..... 24/585.1
5,332,095 A 7/1994 Wu ..... 206/524.8
5,333,736 A 8/1994 Kawamura ..... 206/524.8
5,351,369 A 10/1994 Swain ..... 24/304
5,388,910 A 2/1995 Koyanagi ..... 383/100
5,403,094 A 4/1995 Tomic ..... 383/63
RE34,929 E 5/1995 Kristen ..... 206/524.8
5,439,631 A 8/1995 Schneider et al. ..... 264/293
5,450,963 A 9/1995 Carson ..... 206/524.8
5,480,030 A 1/1996 Sweeney et al. ..... 206/524.8
5,540,500 A 7/1996 Tanaka ..... 383/43
5,544,752 A 8/1996 Cox ..... 206/524.8
5,554,093 A 9/1996 Porchia et al. ..... 493/240
5,554,423 A 9/1996 Abate ..... 428/35.2
5,558,439 A 9/1996 Tilman ..... 383/63
5,618,111 A 4/1997 Porchia et al. ..... 383/63
5,665,408 A 9/1997 Coupe et al. ..... 426/113
5,735,317 A 4/1998 Wu ..... 141/65
5,804,265 A 9/1998 Saad et al. ..... 428/35.2
5,829,884 A 11/1998 Yeager ..... 383/45
5,839,582 A 11/1998 Strong et al. ..... 206/524.8
5,839,831 A 11/1998 Mazzocchi ..... 383/65
5,878,468 A 3/1999 Tomic et al. ..... 24/585.12
5,881,881 A 3/1999 Carrington ..... 206/524.8
5,894,929 A 4/1999 Kai et al. ..... 206/524.8
5,931,189 A 8/1999 Sweeney et al. ..... 137/512.15
5,948,337 A 9/1999 Sakakibara et al. ..... 264/167
5,954,196 A 9/1999 Lin ..... 206/286
5,996,800 A 12/1999 Pratt ..... 206/524.8
6,004,032 A 12/1999 Kapperman et al. ..... 383/5
6,020,013 A 2/2000 Kozma ..... 426/393
6,021,624 A 2/2000 Richison et al. ..... 53/410
6,036,796 A 3/2000 Halbert et al. ..... 156/64
6,039,182 A 3/2000 Light ..... 206/524.8
6,045,264 A 4/2000 Miniea ..... 383/41
6,059,457 A 5/2000 Sprehe et al. ..... 383/63
6,070,397 A 6/2000 Bachhuber ..... 53/512
6,070,728 A 6/2000 Overby et al. ..... 206/524.8
6,085,906 A 7/2000 Lambert ..... 206/524.8
6,110,090 A 8/2000 Ausnit ..... 493/212
6,116,781 A 9/2000 Skeens ..... 383/100
6,120,817 A 9/2000 Archibald et al. ..... 426/106
6,149,304 A 11/2000 Hamilton et al. ..... 383/62
6,152,600 A 11/2000 Tomic ..... 383/63
6,194,011 B1 2/2001 Glaser ..... 426/123
6,231,236 B1 5/2001 Tilman ..... 383/61.2
6,277,547 B1 8/2001 Bourdelais et al. ..... 430/432
6,286,999 B1 9/2001 Cappel et al. ..... 383/5
6,361,212 B1 3/2002 Sprehe et al. ..... 383/63
6,371,643 B2 4/2002 Saad et al. ..... 383/63
6,403,174 B1 6/2002 Copeta ..... 428/34.1
6,408,872 B1 6/2002 Skeens et al. ..... 137/512.15
6,439,429 B1 8/2002 Gross ..... 222/92
6,499,878 B1 12/2002 Dobreski et al. ..... 383/5
6,524,002 B2 2/2003 Tomic ..... 383/64
6,539,691 B2 4/2003 Beer ..... 53/459
6,550,223 B2 4/2003 Xiong et al. ..... 53/434
6,550,966 B1 4/2003 Saad et al. ..... 383/103
6,569,368 B2 5/2003 Machacek ..... 264/155
6,575,191 B2 6/2003 Skeens et al. ..... 137/512.15
6,578,740 B1 6/2003 Hagihara ..... 222/107
6,581,253 B2 6/2003 ErkenBrack ..... 24/428
6,581,641 B2 6/2003 Skeens et al. ..... 137/845
6,604,634 B2 8/2003 Su ..... 206/524.8
6,607,097 B2 8/2003 Savage et al. ..... 222/1
6,607,764 B1 8/2003 Keller ..... 426/107
6,632,021 B2 10/2003 Bois et al. ..... 383/59
6,662,410 B2 12/2003 Kolovich et al. ..... 24/399
6,663,283 B1 12/2003 Cappel ..... 383/5
6,679,027 B2 1/2004 Schreiter ..... 53/412
6,698,925 B2 3/2004 Bentsen ..... 383/63
6,715,644 B2 4/2004 Wilford ..... 222/95
6,729,473 B2 5/2004 Anderson ..... 206/524.8
6,733,622 B2 5/2004 McMahon et al. ..... 156/580.2
6,733,803 B1 5/2004 Vidkjaer ..... 426/62
6,799,680 B2 10/2004 Mak ..... 206/524.8
6,814,991 B2 11/2004 Hiyoshi ..... 426/113
6,837,268 B2 1/2005 Skeens et al. ..... 137/550
6,840,675 B2 1/2005 Knight ..... 383/64
6,860,952 B2 3/2005 Pawloski ..... 156/66
6,871,473 B1 3/2005 Dutt et al. ..... 53/133.4
6,883,665 B1 4/2005 Ahn ..... 206/524.8
6,913,803 B2 7/2005 Peper ..... 428/35.2
6,932,509 B2 8/2005 Shah et al. ..... 383/103
6,964,519 B2 11/2005 ErkenBrack ..... 383/64
6,981,936 B2 1/2006 Plourde et al. ..... 493/214
6,983,845 B2 1/2006 Shah et al. ..... 206/524.8
6,991,109 B1 1/2006 Shannon et al. ..... 206/524.8
7,022,058 B2 4/2006 Lee ..... 493/210
7,137,738 B2 11/2006 Shah et al. ..... 383/103
7,138,025 B2 11/2006 Wu et al. ..... 156/204
2003/0000180 A1 1/2003 Singer ..... 53/512
2003/0024847 A1 2/2003 Malaspina ..... 206/524.8
2003/0037519 A1 2/2003 Ishizaki ..... 55/374
2003/0102245 A1 6/2003 Wang ..... 206/524.8
2003/0118759 A1 6/2003 Yoshikawa et al. ..... 428/35.2
2003/0136798 A1 7/2003 Wilford ..... 222/107
2003/0155269 A1 8/2003 Lee ..... 206/524.8
2003/0169947 A1 9/2003 Taheri ..... 383/5
2003/0177619 A1 9/2003 Cisek ..... 24/585.12
2004/0000501 A1 1/2004 Shah et al. ..... 206/524.8
2004/0000503 A1 1/2004 Shah et al. ..... 206/524.8
2004/0007494 A1 1/2004 Popeil et al. ..... 206/524.8
2004/0050745 A1 3/2004 Lee et al. ..... 206/524.8
2004/0057636 A1 3/2004 Ishizaki ..... 383/44
2004/0091179 A1 5/2004 Anderson ..... 383/63
2004/0114837 A1 6/2004 Koyanagi ..... 383/103
2004/0161178 A1 8/2004 Olechowski ..... 383/210.1
2004/0231294 A1 11/2004 Shannon ..... 53/434
2004/0256050 A1 12/2004 Wu ..... 156/192
2005/0022472 A1 2/2005 Brakes et al. ..... 53/434
2005/0035020 A1 2/2005 Wu et al. ..... 206/524.8
2005/0036717 A1 2/2005 Wu et al. ..... 383/63
2005/0036718 A1 2/2005 Wu et al. ..... 383/103
2005/0036719 A1 2/2005 Wu et al. ..... 383/105
2005/0037163 A1 2/2005 Wu et al ..... 428/34.2
2005/0037164 A1 2/2005 Wu et al. ..... 428/34.2
2005/0065007 A1 3/2005 Wu et al. ..... 493/191
2005/0143243 A1 6/2005 Lee ..... 493/186
2005/0147330 A1 7/2005 Lee ..... 383/116
2005/0147774 A1 7/2005 Lee ..... 428/34.1
2005/0157957 A1 7/2005 Turvey et al. ..... 383/33
2005/0172577 A1 8/2005 Oltrogge ..... 53/434
2005/0173053 A1 8/2005 Ichikawa et al. ..... 156/251
2005/0178691 A1 8/2005 Frenkil ..... 206/524.8
2005/0205455 A1 9/2005 Harrison ..... 206/524.8
2005/0220373 A1 10/2005 Wu ..... 383/105
2005/0220942 A1 10/2005 Wu et al. ..... 426/124
2005/0244083 A1 11/2005 McMahon et al. ..... 383/63
2005/0286808 A1 12/2005 Zimmerman et al. ..... 383/43
2005/0286813 A1 12/2005 Borchardt ..... 383/63
2006/0013514 A1 1/2006 Wu ..... 383/109

| | | | | |
|---|---|---|---|---|
| 2006/0029299 | A1 | 2/2006 | Share et al. | 383/63 |
| 2006/0030472 | A1 | 2/2006 | Hartman et al. | 493/213 |
| 2006/0073291 | A1 | 4/2006 | Wu | 428/35.2 |
| 2006/0093242 | A1 | 5/2006 | Anzini et al. | 383/63 |
| 2006/0110079 | A1 | 5/2006 | Zimmerman et al. | 383/103 |
| 2006/0111226 | A1 | 5/2006 | Anzini et al. | 493/214 |
| 2006/0157140 | A1 | 7/2006 | Bergman et al. | 141/65 |
| 2006/0159576 | A1 | 7/2006 | Bergman et al. | 417/572 |
| 2006/0182371 | A1 | 8/2006 | Borchardt | 383/44 |
| 2006/0193540 | A1 | 8/2006 | Borchardt | 383/44 |
| 2006/0225787 | A1 | 10/2006 | Newrones et al. | 137/246 |
| 2006/0228057 | A1 | 10/2006 | Newrones et al. | 383/103 |
| 2006/0257054 | A1 | 11/2006 | Henn et al. | 383/38 |

FOREIGN PATENT DOCUMENTS

| | | |
|---|---|---|
| JP | 3212355 | 9/1991 |
| JP | 4242544 | 8/1992 |
| JP | 8198274 | 8/1996 |
| JP | 8301358 | 11/1996 |
| JP | 10139050 | 5/1998 |
| JP | 2000118540 | 4/2000 |
| JP | 2006082872 | 3/2006 |
| WO | WO9413556 | 6/1994 |
| WO | WO9833717 | 8/1998 |
| WO | WO0246044 | 6/2002 |
| WO | WO2005002976 | 1/2005 |
| WO | WO2005012107 | 2/2005 |
| WO | WO2005016774 | 2/2005 |
| WO | WO2005040005 | 5/2005 |
| WO | WO2006078387 | 7/2006 |
| WO | WO2006078392 | 7/2006 |
| WO | WO2006127739 | 11/2006 |
| WO | WO2006130384 | 12/2006 |
| WO | WO2007001469 | 1/2007 |

OTHER PUBLICATIONS

International Search Report for PCT Application No. PCT/US2005/26070, which claims priority to U.S. Appl. No. 11/186,131, filed Apr. 18, 2006.

International Preliminary Examination Report for PCT Application No. PCT/US2005/26070, which claims priority to U.S. Appl. No. 11/186,131, filed Apr. 6, 2006.

Written Opinion of the International Search Authority for PCT Application No. PCT/US2005/26070, which claims priority to U.S. Appl. No. 11/186,131, filed Nov. 23, 2006.

International Preliminary Report on Patentability and Written Opinion for PCT Application No. PCT/US2005/029632, which claims priority to U.S. Appl. No. 11/186,131, filed Feb. 13, 2007.

Advertisement for Sealit Vac'N Zip, retrieved from the Internet on Feb. 2, 2006, from www.sealit.tv(domain name no longer active as of Apr. 16, 2007), 3 pages.

* cited by examiner

*Primary Examiner*—Luan K Bui
(74) *Attorney, Agent, or Firm*—Greenberg Traurig, LLP; Barry J. Schindler; Heath J. Briggs

(57) ABSTRACT

The present invention provides a storage system having a storage device having at least one polymeric sheet sealed along a portion of its' periphery to provide an opening to a storage space; a resealable closure structure adapted to seal the opening to the storage space, the resealable closure structure comprising selectively engaging male and female profiles and a sealing compound comprising liquid silicone and at least one filler in proportions suitable for at least incidental contact to food items contained within the storage space; a vacuum valve assembly disposed on the polymeric sheet; a stand-off structure disposed adjacent to the vacuum valve assembly, wherein the stand-off structure has a series of raised surfaces facing the vacuum valve assembly; a portable vacuum pump assembly structured to engage the vacuum valve assembly; and a liquid separator assembly coupled to the portable vacuum pump assembly.

9 Claims, 14 Drawing Sheets

STORAGE SYSTEM HAVING A DISPOSABLE VACUUM BAG

CROSS REFERENCE TO RELATED APPLICATIONS

This application claims the benefit of U.S. Provisional Application Ser. No. 60/590,858, filed on Jul. 23, 2004, 60/602,685 filed on Aug. 19, 2004, and 60/609,920, filed on Sep. 15, 2004 the disclosure of each of which is fully incorporated by reference herein.

FIELD OF THE INVENTION

The present invention relates to a flexible, inexpensive, evacuable storage device optionally having a resealable opening which includes a caulking composition disposed along a closure structure suitable for at least incidental contact to food items contained within the storage device. The present invention also relates to a vacuum storage device and a system for vacuum storage.

Reported Developments

Flexible, sealable storage devices, such as Consumer Storage Bags are commonly used to store items such as, but not limited to, food. These devices typically have a bag body made from a thin, flexible plastic material and include a resealable closure. While inexpensive and easy to use, these devices also allow a quantity of air to be enclosed with the item being stored. Air within a storage device containing food is not desirable as the air reacts with the food and will cause spoliation. Additionally, when storage bags are placed in a below freezing environment, typically in a freezer, "freezer burn" may also damage the food items. Freezer burn occurs when moisture is drawn from the food item and forms ice, typically on the food item. Freezer burn is reduced when entrapped air is substantially eliminated from the storage device with concomitant contouring of the bag wall of the storage device around the food item. Consequently, less moisture will be drawn out of the food item. To this end it is known to evacuate a flexible storage device prior to sealing it. However, such systems heretofore did not include a resealable opening in the storage device.

Prior systems that evacuate flexible storage bags typically include a large device having a vacuum unit and a heat sealer structured to bond sheets of plastic together. The user typically cuts a length of plastic from a roll of plastic and uses the heat sealer to form the plastic into a bag with an opening. After an item has been placed in the bag through the opening, the vacuum unit is then used to remove substantially all of the air from the bag and the bag is sealed. Systems such as these fabricate a bag or pouch that can only be used once. The cost of material is high as reusability is not an option. These large devices are not portable and the act of forming a bag is time consuming.

There is need for a vacuum storage system utilizing a portable vacuum device and optionally a resealable, evacuable, flexible storage device. Resealable closure systems are known, for example, interlocking profiles used in plastic bags. However, in a typical resealable closure, engagement of the sealing structures is rarely perfect, leaving gaps in the profile seal. Moreover, during manufacture of reclosable devices, frequently seals at the ends of the reclosable device distort the engaging portions of the closure which can also provide an unsealed region in the closure. As a consequence of these and other problems associated with resealable closures, a bag utilizing a resealable closure may not be air tight. Consequently when a bag utilizing a resealable closure is subjected to a pressure differential, for example, when it is evacuated or when there is a partial pressure differential of a particular gas between the inside and outside of the bag, gas can leak across the resealable closure and enter, or leave the sealed package through the closure. Thus, gases, for example, air may penetrate into a sealed bag, or for example water vapor may leak from a sealed bag. This is especially a problem when the interior of the bag is at a different pressure than the ambient air, for example, when the bag is under a vacuum, or when the bag contains a gas at a higher or lower partial pressure than the gas is present in the ambient.

Accordingly, there is a need for a flexible, resealable storage device wherein the sealing structure has a resistance to fluid permeability under a pressure differential across the sealing device. Moreover, there is a need for a pre-made, inexpensive, flexible, reusable storage device having a valve structured to operate with a portable vacuum pump. Additionally, there is a further need for a resealable closure that provides for reduction in entrapped air, a flexible bag wall to maintain item conformance, and an air tight seal providing reduced permeability to oxygen, atmosphere intrusion or transmission, bacteria, molds and/or other sources of contamination when used in combination with vacuum pump technology. There is also a need for vacuum pump technology which provides for portability and utility in evacuating a food storage flexible package.

SUMMARY OF THE INVENTION

These needs, and others, are met by the present invention that provides in one aspect a vacuum system comprising: (a) a vacuum pump having a suction side; (b) a vacuum conduit in fluid communication with said vacuum pump suction side, the vacuum conduit comprising: (i) a gas/liquid separator means; (ii) at least one vacuum valve optionally comprising a caulking compound (also termed herein a caulking composition) disposed therein; (iii) optionally, a standoff structure; (iv) optionally one or more quick-connect means; (c) an evacuable package defining an interior space in fluid communication with said vacuum conduit; and (d) optionally, a resealable closure defining an opening of said evacuable package. In some preferred embodiments the vacuum pump is portable.

In one embodiment, the vacuum system comprises a kit containing in one assembly the vacuum pump, a liquid separator means and a portion of the vacuum conduit terminated with one portion of a quick-connect means, and in a second assembly, an additional portion of the vacuum conduit comprising a cooperating portion of the quick-connect means, a vacuum valve, an evacuable package and optionally a stand-off structure. In some preferred embodiments, the vacuum pump assembly is provided in a break-apart form wherein one portion of the system comprises the vacuum pump integrally assembled with some portions of the vacuum conduit, for example, the liquid/gas separator, terminating in a quick-connect means, and the remaining portions of the vacuum conduit are provided integral with the evacuable storage package, for example, a vacuum valve having a cooperating quick-connect means arranged in the remaining portion of the vacuum conduit and integral with the flexible package and optionally a stand-off structure.

In one embodiment the standoff structure comprises an embossed plastic sheet having a channel side and a projection side. In one embodiment the standoff structure is positioned within the evacuable package having the channel side in fluid communication with the vacuum conduit and vacuum valve, and having the projection side proximal to the interior space defined by the package.

In another aspect, the present invention provides an evacuable storage package defining an interior space, a vacuum valve in fluid communication therewith, optionally a standoff structure in fluid communication with the vacuum valve, and optionally a resealable closure defining an opening into the interior space of the package wherein the resealable closure comprises at least one set of interengaging profiles.

In some embodiments the resealable closure defining the opening of the inventive storage package comprises at least one pair of opposed interengaging profiles wherein at least one of said interengaging profiles has associated therewith a portion of the closure comprising a low density sealing material, thus providing a region in the closure having a high degree of conformance with the associated interengaging portion of the closure and as well as insuring that when the closure is end-sealed, a gap free seal is provided. In some embodiments the sealing material comprises a portion of one or both interengaging profiles. In some embodiments the sealing material comprises a portion of the flange or of a post of the closure. In some embodiments the sealing material comprises the entire length of the profiles. In some embodiments the sealing material comprises selected portions of the profiles, such as the periphery portions of one or both of the interengaging profiles. In some embodiments the portion of the closure comprising the sealing material is made from a polyolefin material having a density of not more than 0.925 g/cm$^3$, as defined according to ASTM D1505-03, entitled "The standard test method for density of plastics by density gradient techniques", Book of Standards Volume 08.01 (2005). In some embodiments the resealable closure is used in conjunction with a caulking composition. In one embodiment of the present invention, the caulking composition acts to fill one or more voids between the interengaging profiles, thus reducing the infiltration of ambient into the storage device when it is sealed and placed in a condition of reduced pressure.

In some embodiments the caulking composition is disposed proximal to the interengaging closure profiles such that it is infiltrated into any gaps existing in the closure when the closure profiles are engaged.

In some embodiments the caulking composition comprises a mixture suitable for at least incidental contact to food items. In some embodiments the caulking composition maintains chemical stability throughout a temperature range suitable for food storage and packaging.

In one embodiment the caulking composition is positioned on the first male profile and/or the first female profile. In one embodiment the caulking composition is placed proximal to the interengaging profiles of the closure in one or more positions that permit it to infiltrate gaps formed in the seal formed by the interengaged profiles, for example, as applied to the ends of the closure near the crush area, and as a continuous bead along the closure either on or between one or more of the interengaging profile portions.

In another embodiment of the present invention, the resealable closure device further comprises at least a second set of interengaging profiles positioned in close proximity and parallel to the first set of interengaging profiles. In one embodiment having multiple pairs of interengaging profiles, in addition to sealing material being positioned between each of the engaged portions of the interengaging profiles, a bead of caulking composition may be positioned within the space separating the substantially parallel sets of interengaging profiles.

In one embodiment, the caulking composition comprises constituents such that it maintains integrity, without decomposition, throughout a temperature range suitable for packaging and food storage. Temperatures suitable for packaging and food storage typically range from approximately −10° F. to approximately +160° F. In one embodiment the caulking composition comprises liquid silicone and a filler, e.g. fumed silica, in proportions to provide a grease with a grease consistency number of approximately 2.0, as characterized by National Lubricating Grease Institute (NGLI) standards. In one embodiment, the caulking composition comprises a soy adhesive, such as Pro-cote® soy polymer available from DuPont™. In another embodiment, the caulking composition comprises soy oils, for example, those available from Cargill™ Industrial Oils & Lubricants. In one embodiment the caulking composition comprises two reactive constituents, each residing on a different portion of the closure, such that when the interengaging profiles of the closure are engaged the two constituents are admixed, providing a reaction product which infiltrates at least one void defined by the interengaging closure profiles.

BRIEF DESCRIPTION OF THE DRAWINGS

A full understanding of the invention can be gained from the following description of the preferred embodiments when read in conjunction with the accompanying drawings in which.

DETAILED DESCRIPTION OF PREFERRED EMBODIMENTS

Figure 1:
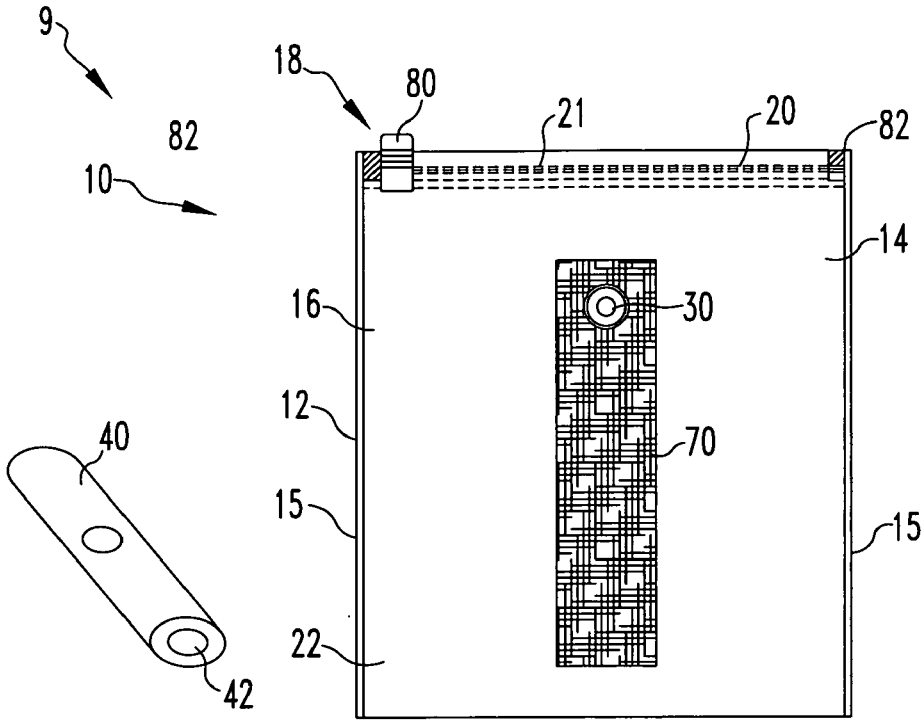
FIG. 1 is a front view of the storage device.

The present invention is now discussed in more detail referring to the drawings that accompany the present application. In the accompanying drawings, like and/or corresponding elements are referred to by like reference numbers. In one embodiment of the present invention, a vacuum system is provided that may include a portable vacuum pump and an evacuable package in communication through a vacuum conduit. The evacuable package may optionally include a stand-off structure and a resealable closure having a caulking composition disposed thereon. In one embodiment, the resealable closure comprises interlocking profiles on which the caulking composition is disposed to provide a gas permeation resistant seal in the resealable closure. The vacuum conduit provides communication between the portable pump and the storage portion of the evacuable bag, wherein the vacuum conduit comprises at least a valve assembly and optionally a stand-off structure. In one embodiment, the stand-off structure provides a means to substantially eliminate the incidence of trapped air within the storage area of the evacuable package. Each of the aspects of the interlocking profiles, the caulking composition, the vacuum valve assembly, the stand-off structure, and the vacuum pump are now discussed in greater detail.

Referring to FIG. 1, in one embodiment, the flexible, resealable storage device 10 comprises a flexible material 12 shaped as an evacuable package 14 (also referred to as evacuable bag). The flexible material 12 is preferably a plastic sheet 16, such as polyolefin. The sheet 16 is, preferably, rectangular. In one embodiment, the sheet 16 is folded over upon itself and two lateral sides 15 are sealed adjacent to the periphery to provide an opening 18 to a storage space 22. As such, the periphery of the bag 14 is substantially sealed. In another embodiment of the present invention, the entire periphery of the evacuable bag 14 is heat sealed.

In one embodiment of the present invention, the evacuable package 14 may be a multilayer bag comprising an inner sealant layer and a barrier/strength layer. The inner sealant layer may comprise LDPE (low density polyethylene) or LLDPE (linear low density polyethylene) and the barrier/strength layer may comprise Nylon, PP (polypropylene) or PET (Polyester). As used herein the term "low density" in conjunction with polyethylene denotes a material having a density of no greater than 0.925 g/cm$^3$, as defined by ASTM standard D-15005-03, wherein the density may be adjusted with the addition of ethylene vinyl acetate (EVA). Another example of a multilayer bag and a method of forming a multilayer bag is described in U.S. Pat. No. 4,267,960, titled "Bag For Vacuum Packaging of Meats or Similar Products", filed Aug. 29, 1979, which is incorporated herein by reference.

In the embodiments of the present invention in which the evacuable bag 14 has an opening 18 to the storage space 22, the bag opening 18 includes a resealable closure 20. The resealable closure 20 may include a set of interlocking profiles. In one example, the set of interlocking profiles 21 may include resilient, selectively engaging male and female profiles 21 (tongue-and-groove closure), structured to seal the opening 18. It will be appreciated that there are numerous interlocking profile geometries known, which can be employed in the present invention.

Figure 2:
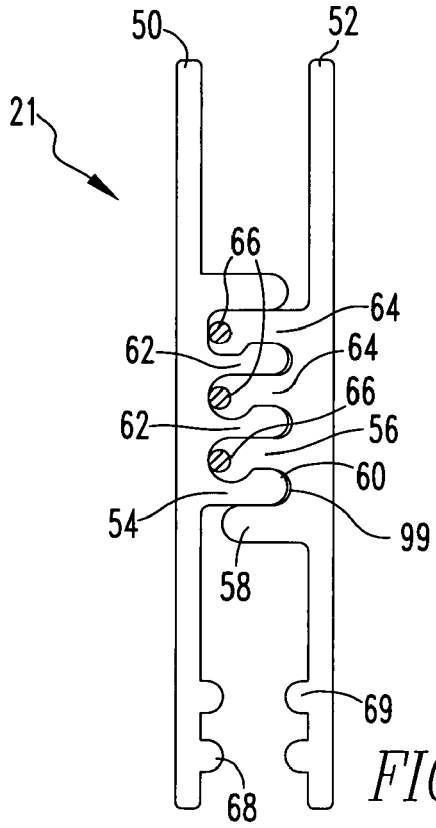
FIGS. 2-7 are cross-sectional views of resealable closure devices including a caulking composition and/or sealing material.

With reference to FIG. 2, in one embodiment, the selectively engaging profiles of closure 21 (also termed herein sometimes for convenience as interengaging profiles) are positioned along two opposing flexible flanges (also termed herein sometimes for convenience as "panels") including a first flange 50 and a second flange 52. As shown in FIG. 2, the two flexible panels 50, 52 may include a raised surface 68, 69 on the inside surface of the panels disposed outside the resealable closure. The first flange 50 includes a male profile having at least one protrusion 54 that extends laterally across the bag 14. The second flange 52 includes a female groove 60 defined by at least two protrusions (56, 58).

Still referring to FIG. 2, there may be multiple protrusions 62, 64, extending from the first and second flanges 50, 52 and forming multiple corresponding male profiles and female grooves (also termed herein sometimes for convenience as a female profile). The protrusions 54, 56, 58, 62, 64 are generally formed from a polyolefin material with a density of not less than approximately 0.925 g/cm$^3$, preferably those described as a High Melt Index polyolefin (HMI). More specifically, the protrusions 54, 56, 58, 62, 64 may comprise High Melt Index (MI) Polyethylene materials and Ethylene Vinyl Acetate (EVA) Copolymers, particularly those having a vinyl acetate content of from about 4 weight percent to about 12 weight percent. In addition, portions of the interengaging profiles and/or surrounding closure structures may include one or more features comprising low melt index or Ultra Low Density (ULD) Polyolefins. As used herein, the term "Ultra Low Density" denotes a density no greater than approximately 0.925 g/cm$^3$. As will be appreciated, the density may be adjusted with the addition of EVA. At least one protrusion 54, 56, 58, 62, 64 may include a bead 66 of polyolefin material with a density of not more than approximately 0.925 g/cm$^3$. In some embodiments a bead 66 of softer material is disposed at the tip of a protrusion 54, 56, 58, 62, 64 and is structured to engage the opposing side 50, 52. The bead 66 of softer material is hereafter referred to as a bead of sealing material 66.

As discussed above, the bead of sealing material 66 may have a lower density than the protrusions 54, 56, 58, 62, 64. During the engagement of closure 21, the lower density and hence more compliant bead of sealing material 66 conforms to the geometry of the higher density and more rigid material comprising the portion of the closure against which the head of the profile abuts upon engagement. The softer material abuts the closure with increased conformance to the abutting surface, advantageously providing a more effective seal against fluid exchange between the interior of the package and the ambient, for example, the intrusion of gas and the exterior atmosphere into the evacuable bag 14. Regardless of the above described embodiments, the resealable closure 21 and its associated interlocking structures can comprise resilient materials of varying densities and melt indexes. Accordingly, embodiments within the scope of the present disclosure, including combinations of materials selected to achieve sealant conditions under vacuum and reduced temperature conditions.

The protrusions forming the male profile may also be referred as a profile having a male head. The protrusions defining the female profile (also referred to as a groove) may also be referred to as profile having a female head and a fillet positioned to provide a groove. The resealable closure structure 20 may further include a closing clip structured to ensure the complete engagement of the closure profiles. Specifically, the closure clip functions to ensure that the interengaging profiles are engaged as the clip is disposed along a first direction, but does not affect the engagement of the profiles when disposed along the direction opposite to that of the first direction.

Regardless of the specific details of construction or interaction of the profiles of resealable closure 21, the interengaging portions of the resealable closure of the present invention preferably includes a caulking composition 99. For example, the caulking composition may be positioned on at least one protrusion 54 on the first flange 50 and/or at least one protrusion 56, 58 on the second flange 52 of the closure 21, wherein the caulking composition 99 assists in creating an air tight seal to the storage space 22. Specifically, during engagement of the first and second flange protrusions 54, 56, 58, 62, 64 of the male and female profiles, the caulking composition 99 sits within the groove 60 to ensure an air-tight seal of the male and female profile. Specifically, the caulking composition 99 is positioned to infiltrate the void space defined between the engaged interlocking profiles of closure 21. Without wishing to be bound by theory, it is believed that the caulking composition 99 acts to infiltrate gaps between the male and female profiles, thus reducing the infiltration of ambient into the storage device when it is placed in a condition of reduced pressure.

Accordingly, the resealable closure 20 is prepared before sealing by introducing the caulking composition onto one or more members of the interengaging profiles or onto a surface of the closure proximal to the interengaging profiles, by methods such as deposition or injection, where it will be distributed during the interlocking process within incipient gaps left between the interengaging profiles after interlocking. Alternately, prior to sealing the closure, the caulking composition can be placed proximal to known areas in which the sealing profile is prone to exhibit gapping, for example, the ends of the male and female profiles 21 at the bag's periphery. The portions of the male and female profiles at the bags periphery are engaged by crush seal, which is often the site of leakage in the closure device. The voids caused by the crush seal engagement at the male and female profile may be filled with caulking composition to substantially reduce the incidence of leakage.

The caulking composition 99 may comprise any material that provides a selectively reversible air tight seal between interengaging members of the resealable closure 21, in which the caulking composition 99 is suitable for at least incidental contact to food items inserted through the opening to the storage space. Preferably, the caulking composition maintains its chemical structure throughout the operable temperature range of storage device 10. The term "suitable" for at least incidental contact denotes compounds that are eligible for compliance with or equivalent to being in compliance with the Federal Food Drug and Cosmetic Act (Title 21 of the Code of Federal Regulations) standards for being generally recognized as safe (GRAS). The term "at least incidental contact" includes at least the unanticipated contact of food items being passed through the opening on which the closure strip is positioned as the food items are being inserted into the storage space. Although indirect contact between the caulking composition and the food items is preferred, in some embodiments the caulking composition may more directly contact the food, so long as the interaction between the food items and the caulking composition is in accordance with the regulations of the Federal Food Drug and Cosmetic Act.

It is noted that caulking compositions that are suitable for at least incidental food contact may be consistent with the classification of materials for "lubricants with incidental food contact" according to Title 21 of the United States Code of Federal Regulations §178.3570 (revised as of Apr. 1, 2003), so long as the materials are consistent with the Federal Food Drug and Cosmetic Act and have an operable temperature range suitable for food storage and packaging. In some preferred embodiments, the operable temperature range of the storage device is defined as the temperature range that the storage bag is typically subjected to in shipping, packaging and food storage applications, for example, food storage applications ranging from approximately −10° F. to approximately 160° F. One example of a caulking composition that is listed as a "lubricant with incidental food contact" according to Title 21 Of the United States Code of Federal Regulations §178.3570 and has an operable temperature range suitable for food storage and packaging comprises dimethylpolysiloxane. Another example is soy-based oils, for example, those distributed by Cargill Corp., and soy-based adhesives, for example, those distributed by DuPont as Pro-cote™ soy polymers.

In order to provide an air tight seal, in some embodiments the caulking composition 99 should be selected to have a work penetration of about 290 to about 340, in which the work penetration is measured at 60 strokes and a temperature of 77° F. in accordance with the National Lubricating Grease Institute (NLGI) system for rating greases by penetration and ASTM D217-97 titled "Standard Test Methods for Cone Penetration of Lubricating Grease" (1997). The NLGI classifies greases by consistency numbers as measured by worked penetration. In a preferred embodiment, the caulking composition 99 has a work penetration on the order of about 290 to about 340 and is classified as a grease having a NLGI consistency number equal to approximately 2. Although it is preferred that the caulking composition 99 have NLGI consistency number equal to approximately 2, greases having lower or higher NLGI consistency numbers may alternatively be utilized, so long as the caulking composition 99 may be applied to the interengaging profiles of closure 21 using conventional injection methods and that the caulking composition 99 is contained within the closure 21 when exposed to temperatures consistent with food storage container applications.

One example of a caulking composition 99, which meets the above requirements is silicone grease. Silicone grease is an amorphous, fumed silica thickened, polysiloxane-based compound. Silicone grease is formed by combining liquid silicone with an inert silica filler. One example of liquid silicone that may be utilized in forming silicone grease having suitable work penetration properties is polydimethylsiloxane having a specific gravity on the order of about 0.973 and a viscosity greater than about 300 centistokes, preferably on the order of about 350 centistokes. Fumed silica, an inert silica filler, has a chain-like particle morphology and when incorporated into liquid silicone forms three dimensional networks that trap the liquid and effectively increases the liquid's viscosity.

Silicone grease may provide desired work penetration values and temperature range to produce an adequately air tight seal between the interengaged profiles of closure 21 by selecting the proper proportions of inert silica filler to liquid silicone. The proportion of inert silica filler to liquid silicone is generally selected to ensure that separation of liquid from solid in the silicone grease is substantially eliminated throughout the operable temperature range of the bag as applied to food container storage. In general, proportions of inert silica filler to liquid silicone are selected to yield a silicone grease viscosity that would not inhibit the application of the silicone grease onto the closure 21. The proportion of inert silica filler to liquid silicone is preferably less than approximately 30% by weight. Even more preferably, the proportion of inert silica filler to liquid silicone is on the order of 6% by weight.

In one highly preferred embodiment, the silicone grease 99 is provided by Clearco™ Silicone Grease (food grade) provided by Clearco Products Co., Inc., Bensalem Pa. Clearco™ Silicone Grease (food grade) has a work penetration value of about 290 to about 340, in which the work penetration is measured at 60 strokes and a temperature of 77° F. Clearco™ Silicone Grease (food grade) comprises 94% dimethylpolysiloxane and 6% fumed silica by weight % and has a specific gravity on the order of about 1.1. Clearco™ Silicone Grease may be utilized at temperatures ranging from approximately −40° F. to approximately 400° F. without chemical decomposition and is therefore well suited for food storage applications. In this embodiment of the present invention, the silicone grease 99 may be positioned along at least one of the male and female profiles of closure 21, wherein incidental contact to food being inserted into the storage space of the storage device typically accounts for less that 5.0 ppb of silicone grease being incorporated into the food item being stored.

In another embodiment of the present invention, the caulking composition may comprise a soy adhesive. Similar to the above-described caulking compositions, the soy adhesive preferably is suitable for incidental food contact and has an operable temperature range suitable for food packaging and storage. One example of a soy adhesive is Pro-cote® soy polymer, which is available from DuPont™. In general, soy adhesive is prepared by extracting and refining soy oil from dehulled, flaked soybeans. The extracted material contains isolated soy protein in its native or globular form; and soluble, low molecular weight sugars. The extract is then processed in a controlled pH environment at tightly controlled temperatures to uncoil globular native soy protein into smaller units, and fractionating the material into uniform polymer fractions. The isolated protein molecule fractions are highly reactive and are chemically treated to modify the protein chain to provide desired adhesive properties. Unmodified soy-based oils may also be employed as a caulking composition. An alternative source of soy based oils and adhesives is the soy products available from Cargill™ Industrial Oils & Lubricants.

As will be appreciated, numerous reactive materials may also be employed as caulking compositions. In particular, materials which may be coated as separate reactants onto separate interengaging portions of the closure which are admixed upon engagement of the interengaging portions of the closure may be utilized. Accordingly, when the closure parts are engaged the admixed reactants will be combined, reacting and forming in-situ a caulking composition which is infiltrated into a least one void defined by the engaged interengaging portions of the closure. One example of such a system comprises a free-flowing reactive polymer liquid and a liquid cross-linking agent, each coated on separate portions of the closure. In this example, when the closure is engaged, the separate portions contact, admixing the polymer and cross-linking agent, providing a viscous, cross-linked polymer caulking composition which is infiltrated into voids in the closure defined by the interengaged portions of the closure. Other examples include the provision of a free-flowing liquid and a gelling agent on separate portions of the closure to form a viscous caulking agent upon admixture, and the provision of a two-part adhesive material which react to form an adhesive upon admixture, for example, formation of a pressure-sensitive adhesive. Other types of chemical transformations will also be apparent to those of skill in the art.

Figure 3:
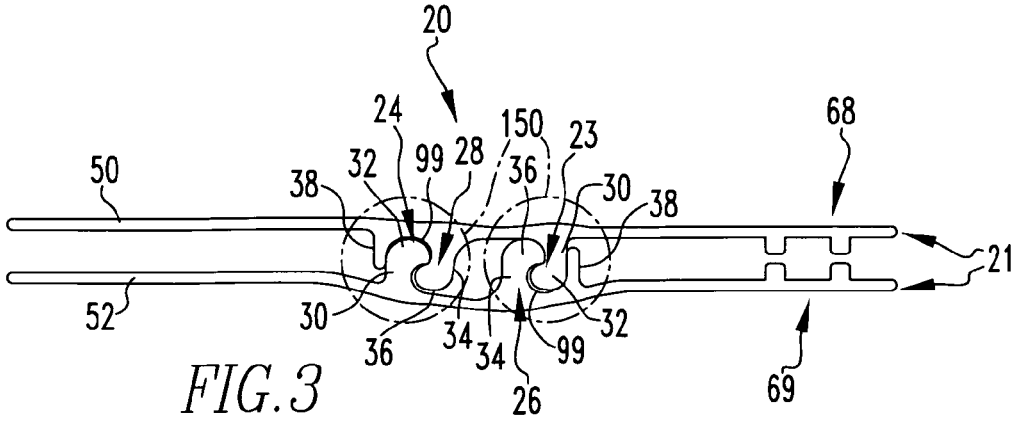

Referring now to FIG. 3, in another embodiment of the present invention, the resealable closure structure includes at least two sets of opposed interlocking profiles 150 respectively having interengaging profiles 24, 28 and 23, 26 selectively engaged in sealing the opening 18 to the storage space 22. Each pair of interengaging profiles comprise a geometry having a symmetrical head (32, 36) extending from a stem (30, 34). Each asymmetrical head is preferably offset on the stem to complimentarily fit into the void space defined by stem 34, post 38 and asymmetrical head 36. The term "asymmetrical head" denotes that the centerline of the head portion of the profile is substantially offset from the centerline of the stem portion of the profile to which it is affixed.

The void space defined by stem 34, post 38 and asymmetrical head 36 comprises a groove configured to selectively engage the asymmetrical head 32 of the corresponding interengaging profile 23, 24. Stem 34, post 38 and asymmetrical head 36 are spaced to selectively engage corresponding interengaging profiles 23, 24. The spacing between the post 38 and stem 34, and between post 38 and asymmetrical head 36 is sufficiently narrow to bias asymmetrical head 32 toward asymmetrical head 36 when profiles 23, 24, 26, and 28 are engaged. The biased positioning of the asymmetrical head 36 in combination with the spacing of post 38 to correspond to the width of asymmetrical heads 23, 24 defining a grove that reversibly interlocks asymmetrical head 23, 24 into the groove when the profiles are engaged.

Still referring to FIG. 3, the resealable closure further includes a caulking composition 99 positioned on at least one of asymmetrical heads 23, 24, 26, and/or 28. The caulking composition 99 may be deposited or injected onto the profiles 23, 24, 26, and/or 28 insuring that an air tight seal is obtained when the profiles 23, 24, 26, 28 are interengaged under varying temperature and pressure conditions. The caulking composition 99 may be positioned along the entire length of the opposed interlocking profiles 150 or only a portion of the opposed interlocking profiles 150, such as the end portions of the opposed interlocking profiles 150 at the bag's periphery.

Figure 4:
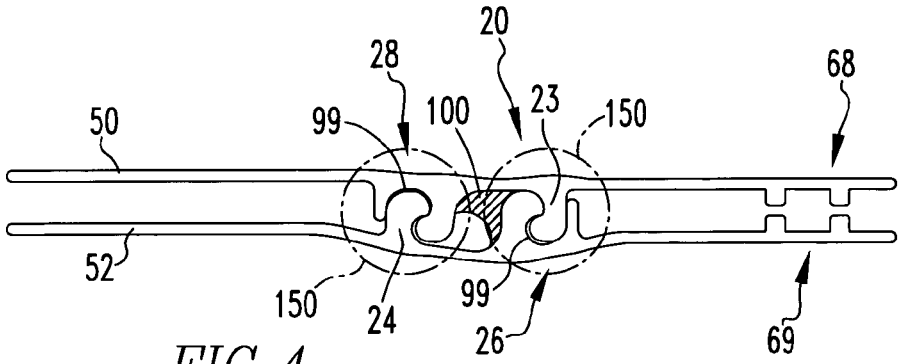

In another embodiment, shown in FIG. 4 (without showing certain reference numbers for clarity), the resealable closure 20 includes a bead of caulking composition 100 in the gap between two parallel sets of opposed interlocking profiles 150. In application, as each set of opposed interlocking profiles 150 are interengaged, the bead of caulking composition 100 contacts the ends of each set of opposed interlocking profiles 150. In a preferred embodiment, the bead of caulking composition 100 fills the void separating the parallel sets of opposed interlocking profiles 150 and contacts the female profiles grooves 26, 28 in each set of opposed interlocking profiles 150, thereby creating a seal. In a further embodiment of the present invention, the resealable closure structure 20 includes a bead of caulking composition 100 in the gap between two parallel sets of opposed interlocking profiles 150 and additional caulking composition 99 between at least one set of interengaging profiles (23, 26) and (24, 28).

Figure 5:
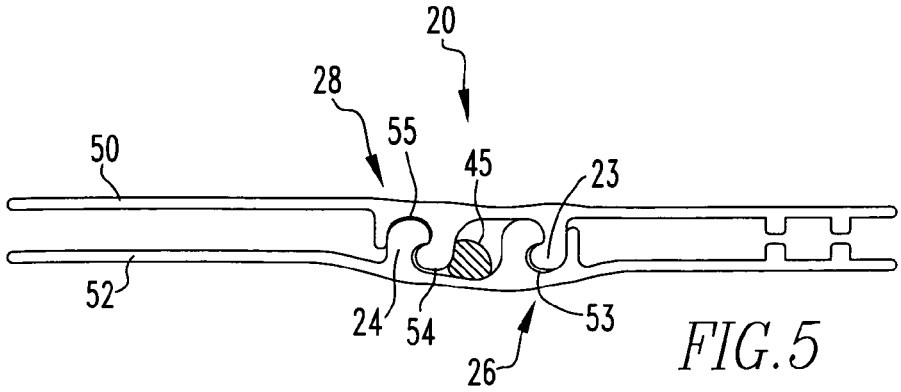
Figure 6:
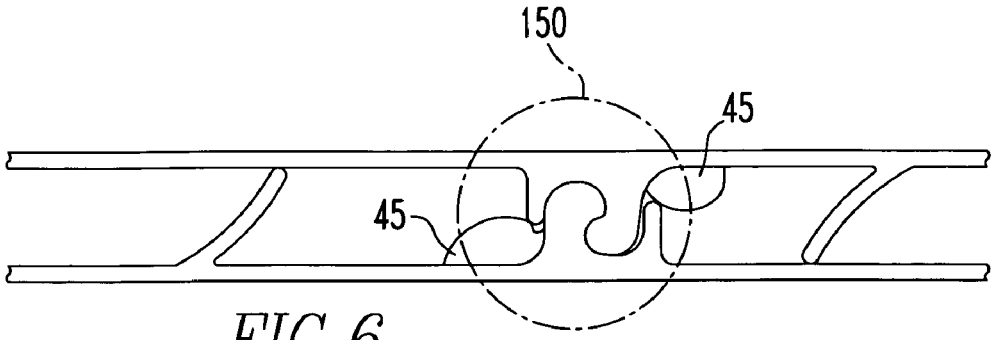

In another embodiment, shown in FIG. 5 (without showing certain reference numbers for clarity), the resealable closure 20 includes a bead of sealant material 45 in the gap between two parallel sets of opposed interlocking profiles 150. The sealant material 45 is a composition of high EVA & high MI polymers selected to provide a high-conformance region in the closure, as described above. Additionally, a bead of sealant material 53, 55 may be applied to the distal tip of each male profile 23, 24. In general, suitable sealant material comprises compositions of polymers as described above or alternatively ultra-low density (ULD) polymers (as defined above) with EVA additives at a 2% or higher loading. Beads of sealant material 45, 53, 55 ensure that an air-tight barrier exists between substantially the entire length of interengaging profiles (23, 26) and (24, 28) when the resealable closure structure 20 is engaged. A bead of sealing material 45 may also be positioned on both sides of a single set of opposed interlocking profiles 150, as depicted in FIG. 6. Similar to the above described embodiments, a bead of caulking composition may be employed between parallel sets of opposed interlocking profiles and/or the caulking composition may be employed between at least one set of interengaging profiles (23, 26) and/or (24, 28).

Figure 7:
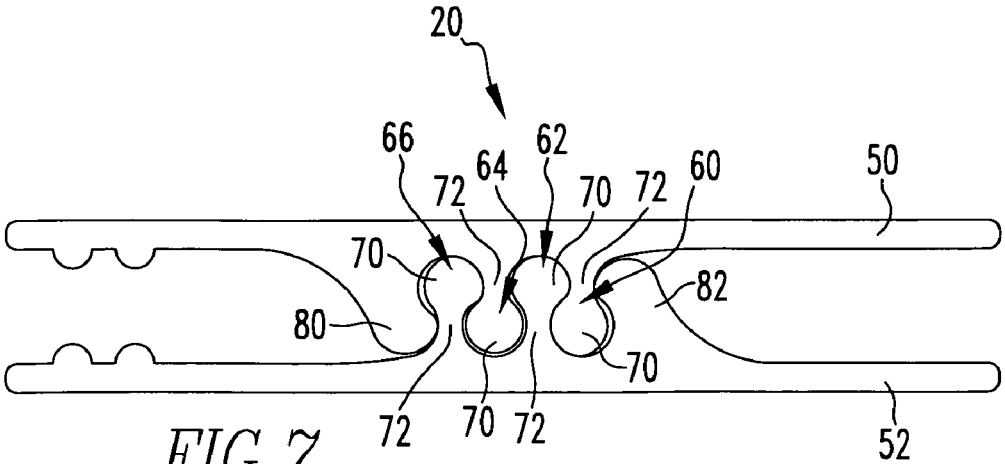

Referring now to FIG. 7, in yet another embodiment of the present invention, the resealable closure 20 may be provided by resealable closure strips having independent and substantially symmetric profiles 60, 62, 64, 66, unlike the embodiments above utilizing asymmetrical structures. Accordingly, the heads (described below) are not offset relative to the stems. That is, each symmetric element 60, 62, 64, 66 includes a head 70 and a stem 72. The head 70 is disposed generally symmetrically on the stem 72. The symmetric profiles 60, 62, 64, 66 are disposed with two elements of each panel 12, 14 and are spaced and configured so that the gap between adjacent elements defines a void region which has a shape corresponding to the shape of the symmetric profiles 60, 62, 64, 66. This embodiment further includes outer elements 80, 82. The outer elements 80, 82 are offset toward the symmetric profiles 60, 62, 64, 66 and bias the symmetric profiles 60, 62, 64, 66 into each other. The outer elements 80, 82 are sized and shaped to correspond to the outer most two symmetric profiles 60, 66. Similar to the above described embodiments, a bead of caulking composition may be employed between one or more of the symmetric profiles 60, 62, 64, 66. Additionally or alternatively the profiles may incorporate a region of sealing material, as described above, for example, by coextrusion of the sealing material with the base material comprising the profile.

Additionally, although not depicted in FIG. 7, multiple sets of opposing interlocking profiles may be employed incorporating independent and substantially symmetric profiles, wherein a bead of caulking composition may be position between two sets of opposing interlocking profiles. The bead of caulking composition may be employed separately or in conjunction with caulking composition disposed between each of the symmetnc profiles. It is noted that the present invention is not limited to profile geometries disclosed above, as any profile geometry may be utilized and is within the scope of the present disclosure, so long as the geometry of the profiles is compatible with the sealing caulking composition in a manner that provides an air-tight seal.

Figure 8:
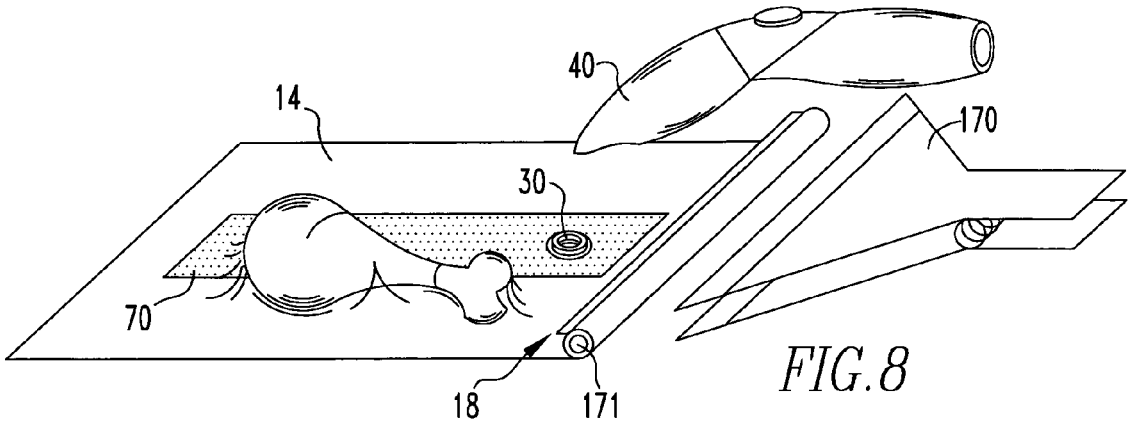
FIG. 8 (perspective view) depicts one embodiment of the present invention in which a clamping means provides a resealable closure.

Referring to FIG. 8, in one embodiment of the present invention, the resealable closure 20 comprises a opening and a clamping means. The clamping means may comprise a clip 170 that is separate from the evacuable bag 14, in which the clip 170 seals the opening 18 of the bag 14 in clamp seal engagement. In another embodiment the clamping means may further include a mandrel 171, wherein the opening 18 of the evacuable bag 14 is rolled around the mandrel 171 and the clip 170 compresses the portion of the evacuable bag 14 rolled about the mandrel in clamp seal engagement.

Referring back to FIG. 1, the storage device 10 further includes a vacuum conduit having one end in fluid communication with the interior of the storage space 22 and which includes a vacuum valve assembly 30. The vacuum valve assembly 30 is in fluid communication with the storage space 22 and defines a sealable passage through which liquids and/or gases may be drawn.

Figure 9:
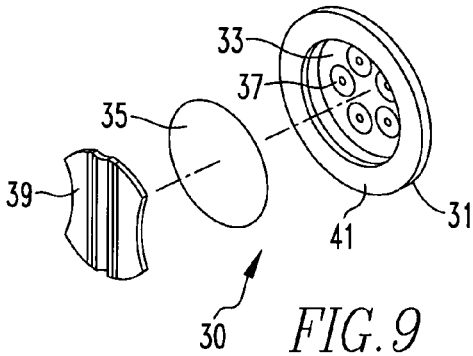
FIG. 9 is an exploded view of the vacuum valve assembly.
Figure 10A:
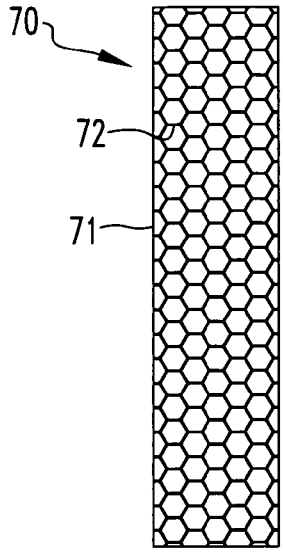
FIGS. 10*a*-10*c* are front views of stand-off structures.
Figure 10B:
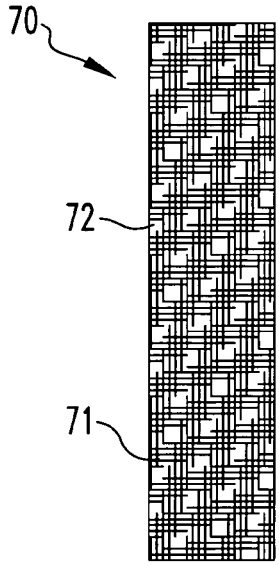
Figure 10C:
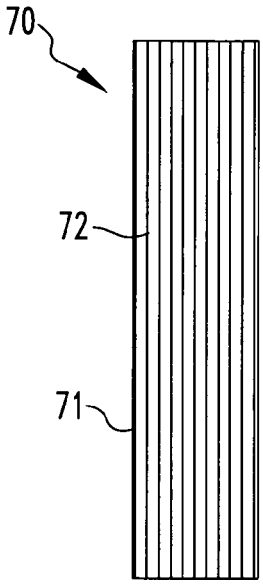

Referring to FIG. 9, in one embodiment the vacuum valve assembly 30 includes a base 31 having a flat surface 33 with at least one opening 37 there through, a resilient valve element 35, and an alignment device 39. The base 31 is sealingly engaged to the evacuable bag 14. The valve element 35 is generally flat and disposed adjacent to the flat surface 33. The alignment device 39 is coupled to the base 31 and is structured to bias the valve element 35 against the flat surface 33. The valve element 35 is structured to move between a first position, wherein the opening 37 is open, and a second position, wherein the opening 37 is sealed. The valve element 35 is normally biased to the second position. The base 31 has a defined shape, such as, but not limited to a concave disk. The outer surface 41 of the base 31 is a generally flat torus.

In one embodiment of the present invention, the vacuum valve assembly may be consistent with the valves disclosed in U.S. Patent Application Publication 11/100,301 (Client Docket Number AVERP3868US), entitled "EVACUATABLE CONTAINER", filed Apr. 6, 2005. It is noted that the sealing nature of the valve element 35 may be enhanced by incorporating a sealing material and/or a caulking composition into the sealing members of the valve assembly. In another embodiment, the vacuum valve assembly 30 may further include at least one rib (not depicted) extending from the interior side of the valve assembly base 31, wherein the rib extending from the base 31 ensures that the valve assembly is not obstructed during application of the vacuum.

Figure 11A:
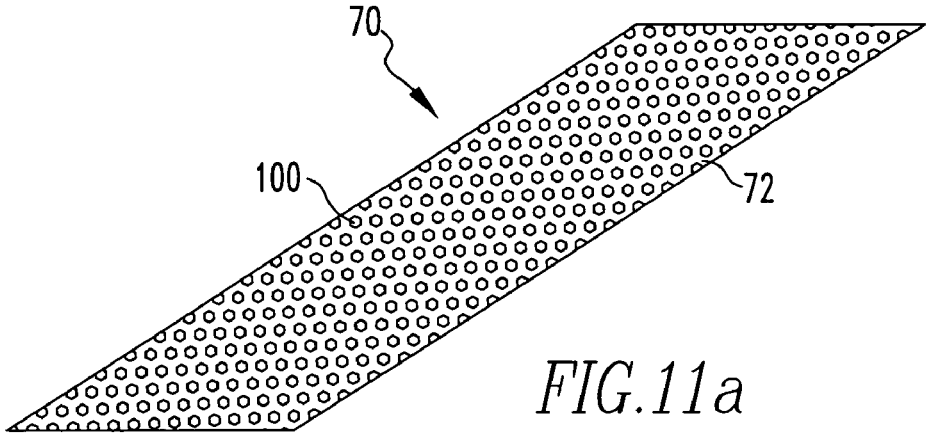
FIGS. 11*a*-11*c* are isometric views of stand-off structures.
Figure 11B:
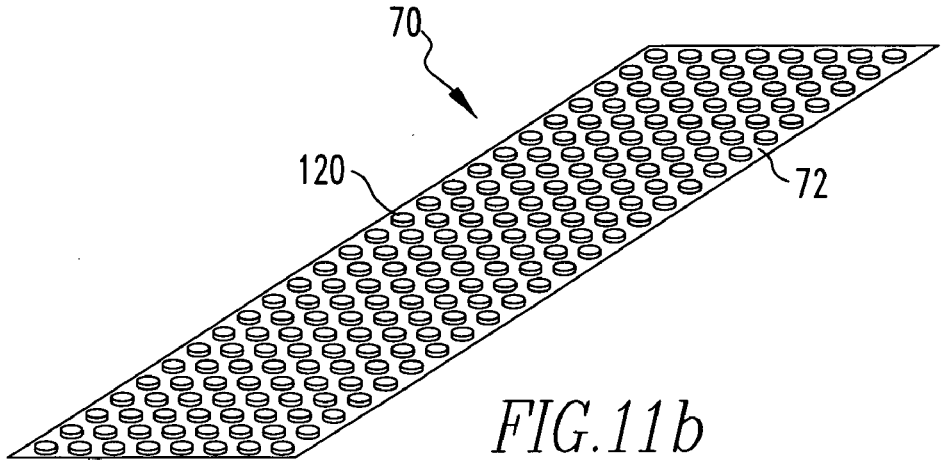
Figure 11C:
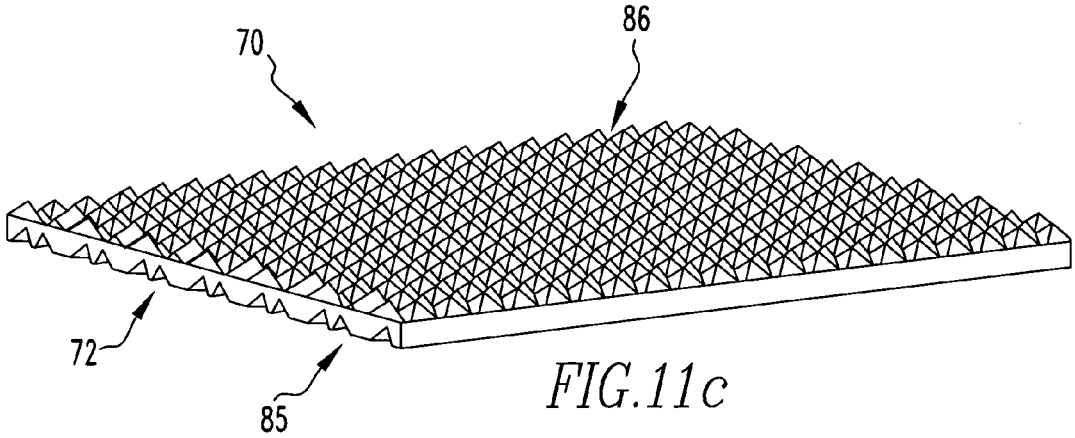
Figure 15:
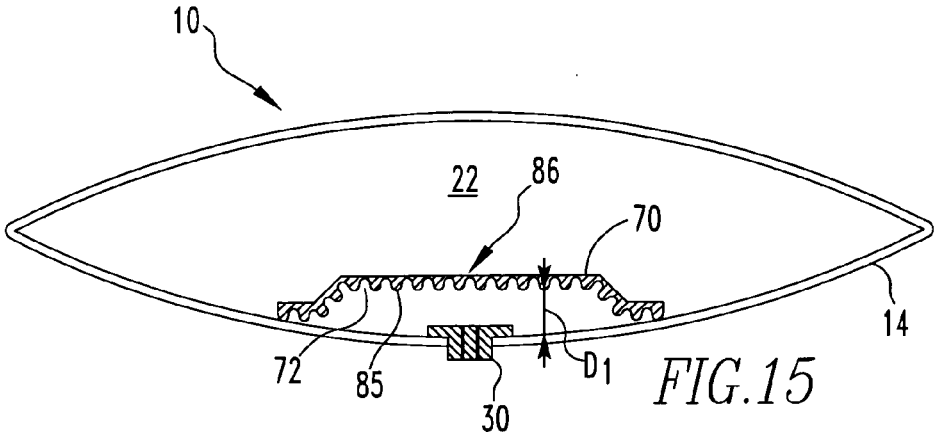
FIG. 15 is a cross-sectional view of the storage device depicted in FIG. 14 along section line 9-9.

As shown in FIGS. 1, 10*a*-10*c*, 11*a*-11*d*, and 15, the storage device 10 further includes a stand-off structure 70. The stand-off structure 70 provides a communicating passage for the removal of liquids and gases. This is, preferably, a strip 71 of film having a pattern of channels 72 embossed, or cut, therein. The stand-off structure channels 72 are designed not to collapse even when the bag 14 is placed under a vacuum. The channels 72 may be in any shape, such as, but not limited to a honeycomb pattern (FIG. 10*a*), a grid or partial grid (FIG. 10*b*), a series of parallel grooves (FIG. 10*c*) or a series of triangular columns (FIG. 11*c*). Referring to FIG. 15, the cavity face 85 of the stand-off structure 70 faces the valve assembly 30 and the protrusion face 86 of the stand-off structure 70 faces the storage space 22.

The honeycomb pattern of channels is depicted in isometric view in FIG. 11*a*, in which the channels 72 that provide the communicating passage for the removal of liquids and gases is defined by a series of polyhedron structures 100. Referring now to FIG. 11*b*, in another embodiment of the stand-off structure 70, the pattern of channels 72 for the removal of liquids and gasses may be provided by a series of curvilinear columns 120.

Figure 12A:
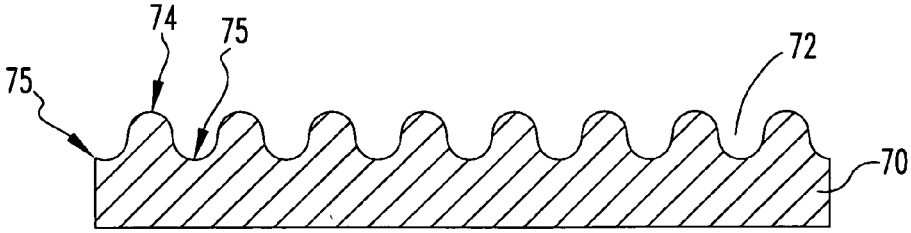
FIGS. 12*a*-12*b* are cross-sectional views of stand-off structures.
Figure 12B:
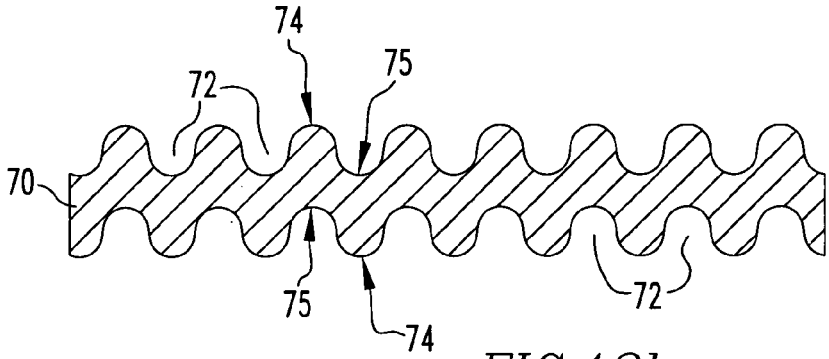

Regardless of the geometry selected for providing the channels, the stand-off structure 70 produces a passage for the removal of liquids and gases by providing a cross-section with a series of raised surfaces and recessed surfaces. In one embodiment, the standoff structure is integral with a fluid conduit providing fluid communication between the interior of the storage device and a vacuum system by which the storage device is evacuated, and which comprises a vacuum valve, the standoff structure, optionally a quick-connect device, optionally a liquid/vapor separator and the suction side of a vacuum pump. Referring to FIG. 12*a*, channels 72 are provided in the area defined between the raised surfaces 74 and recessed surfaces 75 of the stand-off structure's 70 cross-section. The stand-off structure 70 may have a series of channels 72 on one side of the standoff structure 70, as depicted in FIG. 12*a*, or on both sides of the stand-off structure 70, as depicted in FIG. 12*b*. Referring to FIG. 11*c*, in one embodiment of the present invention, the cavity face 85 of the stand-off structure 70 comprises channels 72 and the protrusion side 86 comprises a series of communicating passages produced by a plurality of polyhedron structures.

Figure 13A:
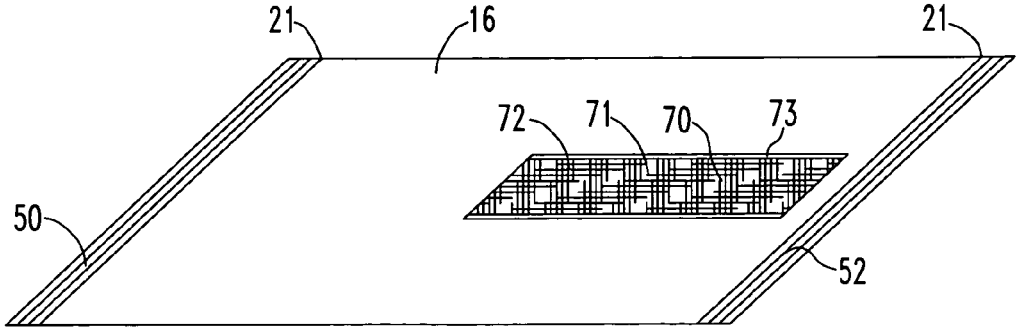
FIGS. 13*a*-13*d* are isometric views of embodiments of the storage device in an unfolded condition.
Figure 13B:
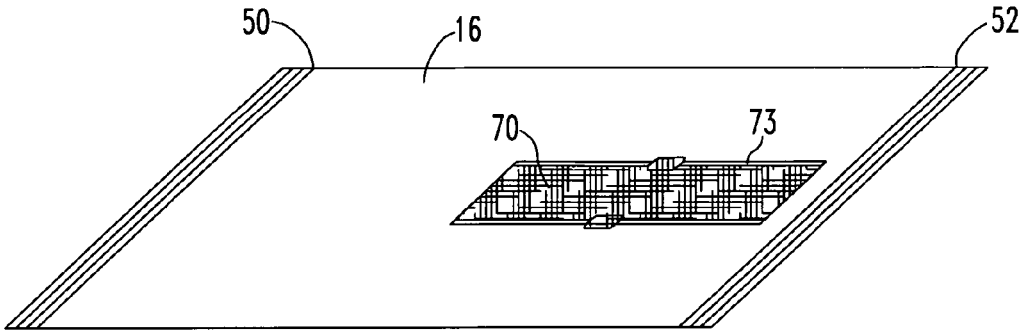
Figure 13C:
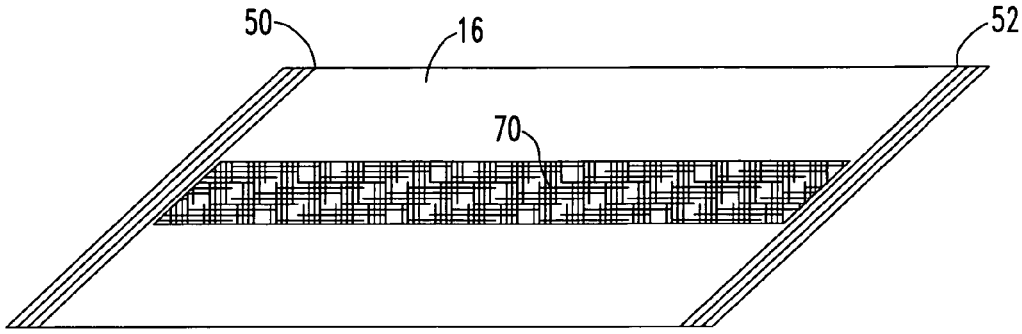
Figure 13D:
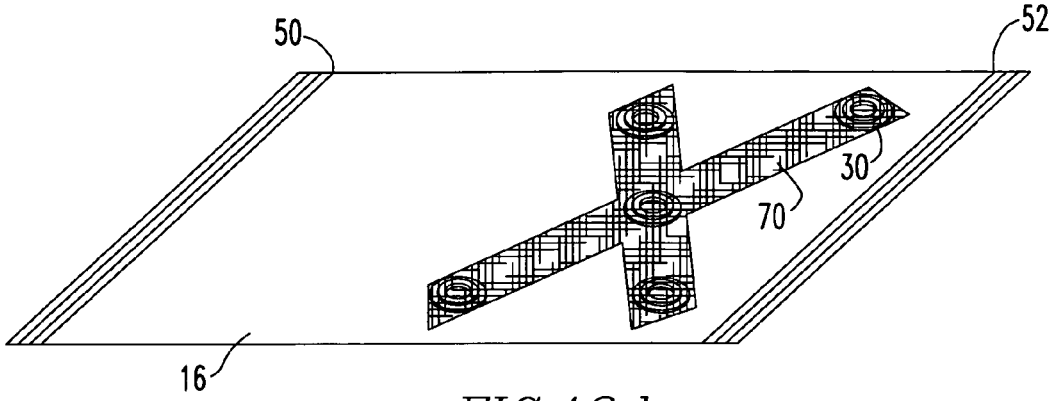

As shown in FIGS. 13*a*-13*d*, 14 and 15, the stand-off structure 70 may be bonded to the inner side of the bag 14, on the same side of the evacuable bag 14 as the valve assembly 30. Although thermal bonding of the stand-off structure 70 to the side of the evacuable bag 14 is preferred, any conventional bonding method may be utilized as known by those skilled in the art. The stand-off structure 70 is positioned at a location corresponding to the location of the vacuum valve assembly 30. Multiple valve assemblies 30 and multiple stand-off structures 70 may be utilized in a single storage device 10, as depicted in FIG. 13*d*.

As shown in FIG. 13*a*, the coupling of the stand-off structure 70 may be accomplished prior to folding over the plastic sheet 16, wherein the entire side periphery 73 of the stand-off structure is bound to the plastic sheet 16. Referring to FIG. 13*b*, in another embodiment, the coupling of the stand-off structure 70 to the storage device 10 may be accomplished by bonding only selected portions of the stand-off's side periphery 73 to the plastic sheet 16. Additionally, as opposed to limiting the stand-off structure 70 to a single side of the storage device 10, the stand-off structure 70 may be coupled to extend across both sides of the bag 14, as shown in FIG. 13*c*. In another example, the stand-off structure 70 may be positioned to extend diagonally across the plastic sheet as depicted in FIG. 13*d*. It is noted that examples depicted in FIGS. 12*a*-12*d* have been provided for illustrative purposes and that other configurations in the positioning of the stand-off 70 are within the scope of the present invention, so long as the stand-off 70 is positioned to be in fluid communication with the vacuum valve assembly 30 in a manner that allows for the removal of liquids and gasses from the storage device 10.

Figure 14:
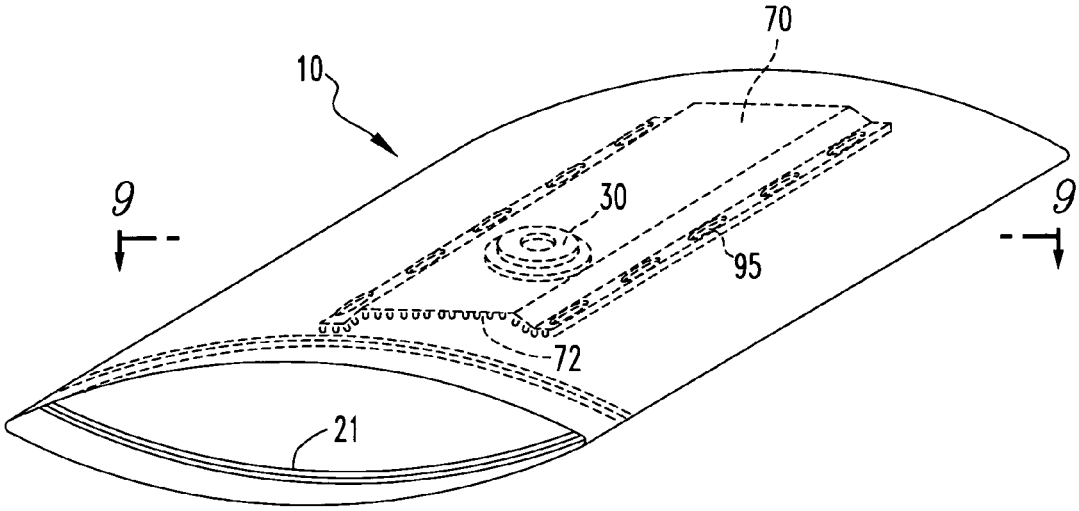
FIG. 14 is an isometric view of the storage device in a folded condition.

FIG. 14 depicts the positioning of the stand-off structure 70 once the plastic sheet 16 is folded over upon itself and two lateral sides 15 are sealed adjacent to the periphery forming the storage space 22. The stand-off structure 70 is clearly depicted as being bound to the face of the plastic sheet 16 within the storage space 22, wherein the channels 72 of the stand-off structure 70 face the surface of the plastic sheet 16 to which the stand-off structure 70 is bound. In an alternate embodiment, the stand off structure 70 may include channels 72 on both sides of the stand off structure 70 (FIG. 12*b*), in which the channels on a first side of the stand off structure 70 face the surface of the plastic sheet 16 to which the stand-off structure 70 is bound and the channels 72 on the second side of the stand off structure 70 face the opposing plastic sheet.

FIG. 15 illustrates the cross-section of the storage device 10 depicted in FIG. 14 along reference line 9-9, in which the channels 72 of the stand-off structure 70 are clearly depicted as facing away from the storage space 22 and towards the vacuum valve assembly 30 as well as the surface of the plastic sheet 16 to which the stand-off structure 70 is bound. Prior to the application of a vacuum, the portion of the stand-off structure 70 opposing the valve assembly 30 may be separated from valve assembly 30 by a distance D1 ranging from about 0.003" to about 0.25".

In one application, a vacuum pump is attached to the vacuum conduit which includes at least one vacuum valve and in fluid communication therewith, at least one standoff structure. The vacuum pump is operated, applying a vacuum to the interior of the storage device through the vacuum valve assembly 30 and standoff assembly causing the storage space 22 to collapse upon a food article contained therein. During the application of the vacuum, the stand-off structure 70 separates the food article from the vacuum valve assembly 30, ensuring that the food article does not obstruct the flow of air or liquids to be removed from the storage space 22, and insuring that the walls of the storage device conform tightly to the food article. Additionally, as the vacuum causes the portion of the plastic sheet 16 opposing the stand off structure 70 to collapse upon the raised portions of the stand-off structure 70, any remaining liquid and air may be removed via the stand-off structure's 70 recessed channels. During the application of the vacuum, the distance D1 separating the valve assembly 30 from the opposing raised surfaces of the stand-off structure 70 may be substantially eliminated while maintaining an effective passageway for removing the remaining air and liquids from the storage device through the stand-off structure's 70 recessed channels.

Figure 16A:
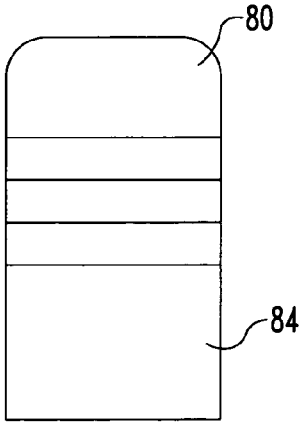
FIGS. 16*a*-16*b* illustrate the front view of the closing clip and the side view of the closing clip.
Figure 16B:
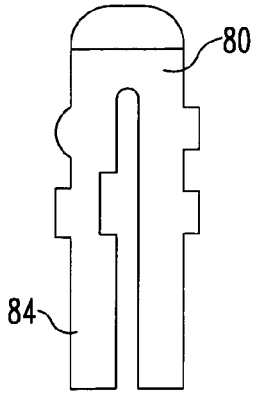
Figure 17:
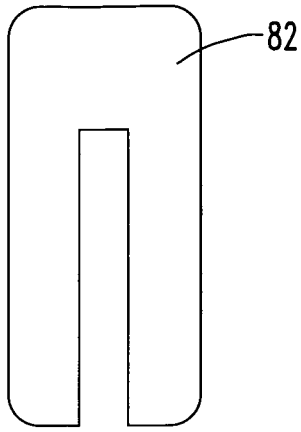
FIG. 17 is a side view of an end stop.

It will be appreciated that the resealable closure structure 20, shown in FIG. 1, may be operated by hand, however, as shown in FIGS. 1, 16*a* and 16*b*, the resealable closure 20 may also include a closing clip 80 and end clips 82. The closing clip 80 is a rigid U-shaped member 84 structured to fit snugly over at least the first and second side protrusions 54, 56, 58. The U-shaped member 84 is structured to bias the male protrusion 54 into the groove 60 formed by the other protrusions 56, 58 as the U-shaped member 84 is moved over the protrusions 54, 56, 58. In the embodiments of the present invention incorporating multiple protrusions, the U-shaped member 84 may be structured to also fit snugly over multiple protrusions 62, 64, wherein the U-shaped member also biases at least one additional male protrusion 62 into at least one additional groove formed by the other protrusions 64. The closure clip 80 functions to ensure that the interlocking profiles 21 are engaged as the clip 80 is disposed along a first direction, but does not affect the engagement of the interlocking profiles 21 when disposed along the direction opposite to that of the first direction. More specifically, the closure clip 80 does not separate the interlocking profiles when being traversed over engaged interlocking profiles 21. The end clips 82 are bonded to the ends of the resealable closure 20 and arrest the motion of the closing clip as it traverses the bag 14. The cross-section of an end clip is depicted in FIG. 17.

As mentioned above, in one embodiment the reclosable storage device comprises a portion of a system which includes a vacuum device having a low pressure side attached to a vacuum conduit which is in fluid communication with the interior of the storage device and which conduit includes a vacuum valve (described above). Optionally, the assembly includes also a quick-disconnect means in the vacuum conduit between the vacuum pump and the storage device and optionally includes a gas/liquid separator means in the vacuum conduit between the suction side of the vacuum pump and the storage device.

Figure 18A:
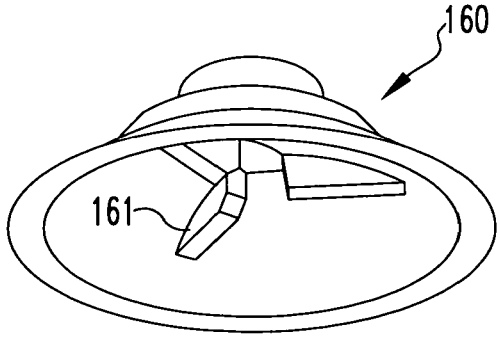
FIG. 18(*a*) is an isometric view of a suction cup tip of a portable vacuum pump and FIG. 18(*b*) depicts a side cross-sectional view of the suction cup tip depicted in FIG. 18(*a*).
Figure 18B:
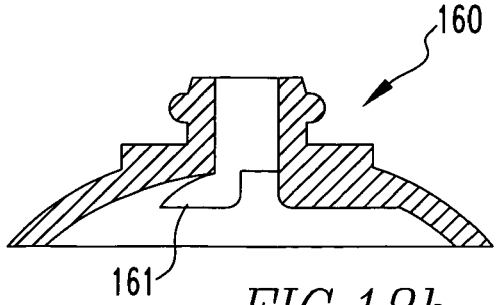
Figure 21:
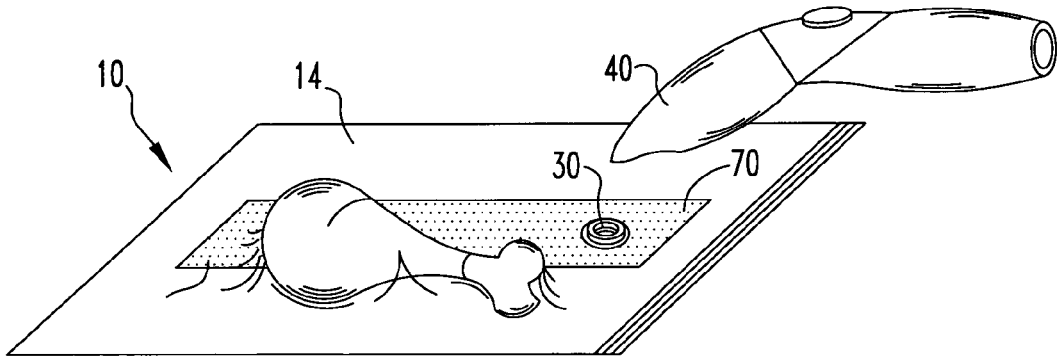
FIG. 21 is an isometric view of a bag in use, wherein the bag includes a stand-off structure and vacuum valve assembly.

As will be appreciated, any number of vacuum devices can be utilized to evacuate a reclosable storage device in accordance with the present invention, however, in some embodiments, it is preferred to employ a hand-held or portable vacuum pump. An example of one suitable portable device is illustrated in FIG. 21. The portable vacuum pump assembly illustrated in FIG. 21, pump 40, includes a power source, such as a battery, a vacuum pump having a suction side and an exhaust side, and a motor, (all not shown). The vacuum pump may be connected to the fluid conduit connected to the interior of the storage device by a quick-connect means, wherein one portion of the quick-connect means is integral with the vacuum pump assembly and another portion of the quick-connect means is integral with the flexible storage device. An example of this is illustrated in FIG. 1 as engagement end 42 of vacuum pump 40. As illustrated, engagement end 42 has a defined shape, for example, a convex disk, concave disk or a disk shaped to fit within the medial opening of the outer surface of a vacuum valve assembly's defining one end of a fluid conduit associated with a storage device. The engagement end 42 has a defined shape structured to engage the vacuum valve assembly 30 and defines a passage that is in fluid communication with the vacuum pump 40. Thus, the engagement end of the portable vacuum pump 40 may function as a quick-connect means, for example, as illustrated in FIGS. 18(*a*) and 18(*b*) a suction cup tip 160, in which the suction cup tip 160 incorporates integrated stand off structures 161 to maintain suction during application of the vacuum as depicted in FIGS. 18(*a*) and 18(*b*). It is noted that other quick-connect means, for example, vacuum tips (engagement end 42) have been contemplated and are within the scope of the present invention, so long as the engagement end 42 geometry provides a quick connect engagement with the vacuum valve assembly. A "quick connection engagement" requires sealing of the valve assembly 30 and engagement end 42 without separate fasteners or the removal of separable sealing members. It will be appreciated that the system may also utilize more conventional coupling means to join the vacuum system to the fluid conduit to provide fluid communication between the suction side of the vacuum pump and the interior of the storage device.

Figure 19:
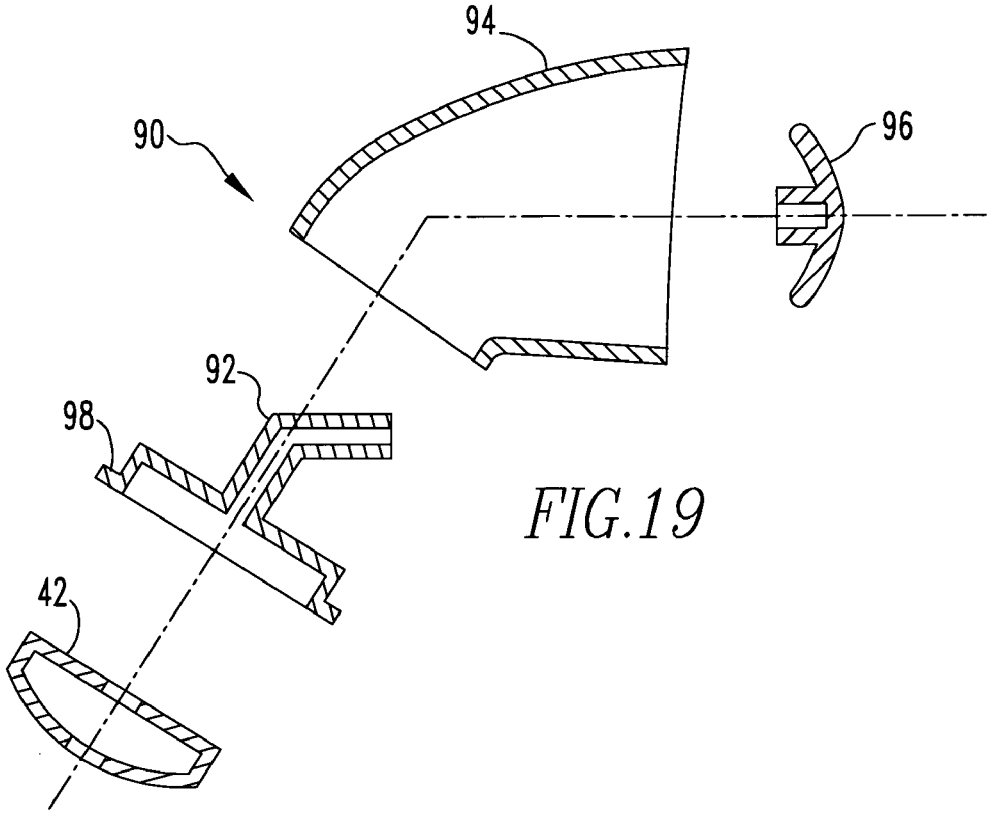
FIG. 19 is an exploded, cross-sectional view of the liquid separator.
Figure 20:
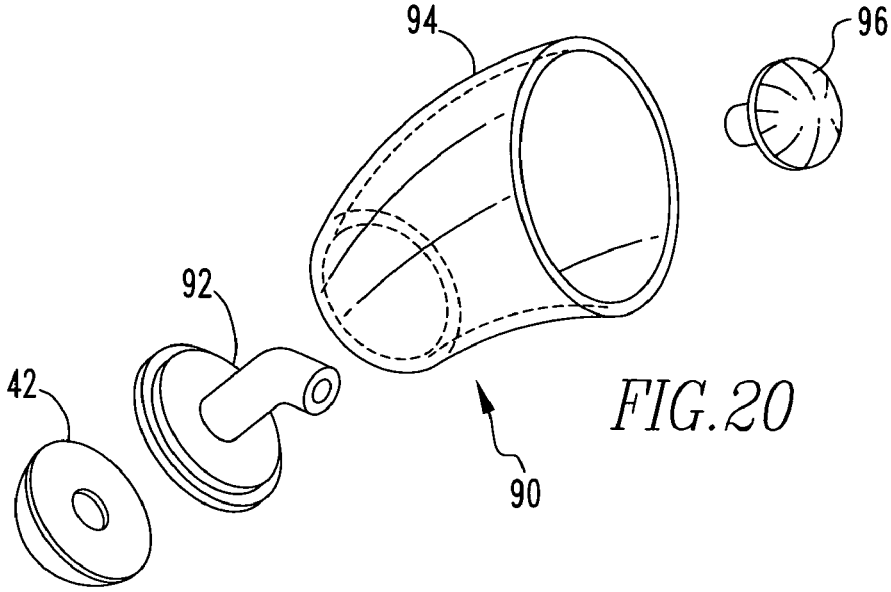
FIG. 20 is an exploded, isometric view of the liquid separator.

As shown in FIGS. 19 and 20, the assembly may also include a liquid separator assembly 90. The liquid separator assembly 90 is structured to collect a liquid, while allowing gases to be drawn into the suction side of the vacuum pump assembly 40. In one embodiment, the liquid separator assembly 90 includes a tube 92, and accumulator housing 94 and a diverter 96. The tube 92 further includes a base 98 structured to sealingly engage both the attachment end 42 and the accumulator housing 94. The accumulator housing 94 is shaped as a cup and is structured to contain a liquid. The diverter 96 is structured to engage the distal end of the tube 92 and redirect the fluid flow from an axial direction in the tube 92 into the accumulator housing 94. Thus, when assembled, the attachment end 42 is coupled to the lower side of the tube base 98 and the accumulator housing 94 is coupled to the upper side of the tube base 98. The diverter 96 is disposed at the distal end of the tube 92. Thus, there is a fluid passage from the attachment end 42 into the accumulator housing 94.

In operation, the portable vacuum pump 40 is structured to engage the vacuum conduit connected to the interior of the storage device, for example, as illustrated, the outer surface of the vacuum valve assembly 30. When the portable vacuum pump 40 is engaged and actuated the vacuum valve assembly 30 is actuated by the resultant pressure differential, the valve element 35 moves into the first position (described above) and the vacuum conduit passage is open and fluid (gas and liquid) is withdrawn from the bag 14 through the vacuum conduit into the suction side of the vacuum pump. The fluid may be both liquid and gas. When a separator assembly is present in the vacuum conduit, liquid and gas are drawn into the liquid separator assembly 90, the liquid contacts the diverter 96 and is deposited in the accumulator housing 94. Thus, the liquid is not drawn with the gas towards the vacuum pump. The gas is exhausted via the vacuum pump from the vacuum pump assembly 40. When the accumulator housing 94 needs to be emptied, a user may simply remove the tube 92 and base 98 allowing the liquid to drain from the vacuum pump assembly 40.

When a portable vacuum pump 40 is actuated, air is withdrawn from the storage space 22. Thus, as shown in FIG. 21, an item, such as a food article 1 shown in ghost, may be placed in a storage device 10. The stand-off structure 70 is structured to prevent the plastic sheet that forms the evacuable bag 14, or an item within the bag 14, from obstructing the vacuum valve assembly 30. That is, the channels 72 on the stand-off structure 70 provide a path for liquids and gases within the bag 14 to reach the valve assembly 30. In the embodiments of the invention in which the stand-off assembly has channels positioned on both sides of the stand-off structure 70, the channels contacting the item contained within the bag ensures that liquids and gasses are not trapped between the stand-off structure 70 and the item contained within the storage space.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A storage bag comprising:

at least one polymeric sheet;

wherein the polymeric sheet has at least a top portion, a bottom portion, and a side portion;

wherein the polymeric sheet is sealed along at least a portion of the side and bottom portions thereby defining a storage bag having a storage space;

a closure comprising a pair of opposed interengaging profile members;

wherein the opposed interengaging profile members are capable of repeated engagement and disengagement; and wherein the closure is located along the top portion of the polymeric sheet;

a grease composition along at least a substantial portion of the closure, wherein the grease composition is positioned at least proximal to at least one of the opposed interengaging profile members; and wherein both when the opposed interengaging profile members are engaged and when the opposed interengaging profile members are disengaged and again engaged, the grease composition creates a selectively reversible gas-permeation resistant closure;

a vacuum valve assembly integrated with a portion of a first panel of the storage bag;

wherein the vacuum valve assembly has a substantially flat surface coupled to an exterior portion of the first panel of the storage bag;

wherein the vacuum valve assembly is configured to accommodate a vacuum pump for removal of fluids from the storage space;

a strip of film positioned within the interior of the storage bag and coupled to at least a portion of the first panel of the storage bag, the strip of film having a series of channels on a first side thereof, wherein the channels face the vacuum valve assembly and provide a communication passage for removal of fluids from the storage bag.

2. The storage bag of claim 1, wherein the grease composition is positioned as a continuous bead along at least a portion of the closure.

3. The storage bag of claim 1, wherein the grease composition is positioned on at least one of the opposed interengaging profile members.

4. The storage bag of claim 1, wherein the grease composition maintains chemical stability throughout a temperature range suitable for food storage and packaging.

5. The storage bag of claim 4, wherein the grease composition has a work penetration value of 290 to 340.

6. The storage bag of claim 1, wherein only a portion of the periphery of the stand-off structure is coupled to the first panel of the storage bag.

7. The storage bag of claim 1, wherein the distance between the first side of the strip of film and the vacuum valve assembly is from 0.003 inches to 0.25 inches.

8. The storage bag of claim 1, wherein the pair of opposed interengaging profile members is a first pair of opposed interengaging profile members, wherein the closure comprises a second pair of opposed interengaging profile members, and wherein the first pair of opposed interengaging profile members extend the length of the opening the second pair of opposed interengaging profile members extend the length of the opening and substantially parallel to the first pair of opposed interengaging profile members.

9. The storage bag of claim 8, wherein the grease composition is positioned within the space between the first pair of opposed interengaging profile members and the second pair of opposed interengaging profile members.

* * * * *

UNITED STATES PATENT AND TRADEMARK OFFICE

CERTIFICATE OF CORRECTION

PATENT NO. : 7,290,660 B2
APPLICATION NO. : 11/186131
DATED : November 6, 2007
INVENTOR(S) : Paul A. Tilman et al.

It is certified that error appears in the above-identified patent and that said Letters Patent is hereby corrected as shown below:

Title Page should read:

(76) Inventors: Paul A. Tilman, W 4852 Forest Lane, Sherwood, WI (US) 54169;
Michael E. Schreiter, 1912 Schaefer Circle, Appleton, WI (US) 54915;
James E. Buchman, W 8695 Spring Road, Hortonville, WI (US) 54944;
Paul J. Tretina, 4816 Kellywood Drive, Glen Allen, VA (US) 23060;
Mladomir Tomic, 4624 W. Grand Meadows Drive, Appleton,
WI (US) 54915

Signed and Sealed this

Eighth Day of April, 2008

JON W. DUDAS
*Director of the United States Patent and Trademark Office*